US008867944B2

(12) United States Patent
Noguchi

(10) Patent No.: US 8,867,944 B2
(45) Date of Patent: Oct. 21, 2014

(54) FUSER AND TEMPERATURE CONTROL METHOD OF FUSER

(75) Inventor: Tadashi Noguchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 345 days.

(21) Appl. No.: 13/036,385

(22) Filed: Feb. 28, 2011

(65) Prior Publication Data

US 2011/0217063 A1 Sep. 8, 2011

Related U.S. Application Data

(60) Provisional application No. 61/309,946, filed on Mar. 3, 2010.

(51) Int. Cl.
*G03G 15/20* (2006.01)

(52) U.S. Cl.
CPC ..... *G03G 15/20* (2013.01)
USPC ..... 399/70; 399/67; 399/69; 399/128; 399/313

(58) Field of Classification Search
USPC ..... 399/329, 307, 70, 277, 16, 258, 16.258; 400/120.01
See application file for complete search history.

(56) References Cited

U.S. PATENT DOCUMENTS

2005/0163524 A1* 7/2005 Shiobara et al. ..... 399/69
2008/0298860 A1* 12/2008 Omata ..... 399/321
2009/0238596 A1* 9/2009 Shiobara et al. ..... 399/69

FOREIGN PATENT DOCUMENTS

JP 2002-067446 3/2002
JP 2004-133216 4/2004
JP 2008-008936 1/2008
JP 2009-173380 8/2009

OTHER PUBLICATIONS

Japanese Office Action for Japanese Patent Application No. 2011-046877 mailed on Dec. 10, 2013.
Japanese Office Action for Japanese Patent Application No. 2011-046877 mailed on Mar. 11, 2014.

* cited by examiner

*Primary Examiner* — Walter L Lindsay, Jr.
*Assistant Examiner* — Roy Y Yi
(74) *Attorney, Agent, or Firm* — Amin, Turocy & Watson, LLP

(57) ABSTRACT

According to one embodiment, a fuser including a heating section which heats a hot-melt visualizing material fixed to a sheet medium and the sheet medium, a heat generator which increases the temperature of the heating section in accordance with supply of power, a temperature detector which detects the temperature of the heating section, and a controller which outputs temperature information during the increasing of the temperature on the basis of the temperature of the heating section detected by the temperature detector while the temperature of the heating section increases so that notification can be provided that fusing is possible for an image only using a single color hot-melt visualizing material.

18 Claims, 12 Drawing Sheets

FUSER AND TEMPERATURE CONTROL METHOD OF FUSER

CROSS-REFERENCE TO RELATED APPLICATIONS

This application is based upon and claims the benefit of priority from: U.S. Provisional Application No. 61/309,946 filed on Mar. 3, 2010, the entire contents of each of which are incorporated herein reference.

FIELD

Embodiments described herein relate generally to an image forming apparatus and fuser unit use in the image forming apparatus.

BACKGROUND

A toner (a visualizing agent) moves to a sheet medium on the basis of image information and is integrated with the sheet medium. The sheet medium (integrated with the toner) is a hard copy.

A fuser integrates the toner with the sheet medium.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

In general, according to one embodiment, a fuser comprising: a heating section which heats a hot-melt visualizing material fixed to a sheet medium and the sheet medium; a heat generator which increases the temperature of the heating section in accordance with supply of power; a temperature detector which detects the temperature of the heating section; and a controller which outputs temperature information during the increasing of the temperature on the basis of the temperature of the heating section detected by the temperature detector while the temperature of the heating section increases so that notification can be provided that fusing is possible for an image only using a single color hot-melt visualizing material.

Embodiments will now be described hereinafter in detail with reference to the accompanying drawings.

Figure 1:
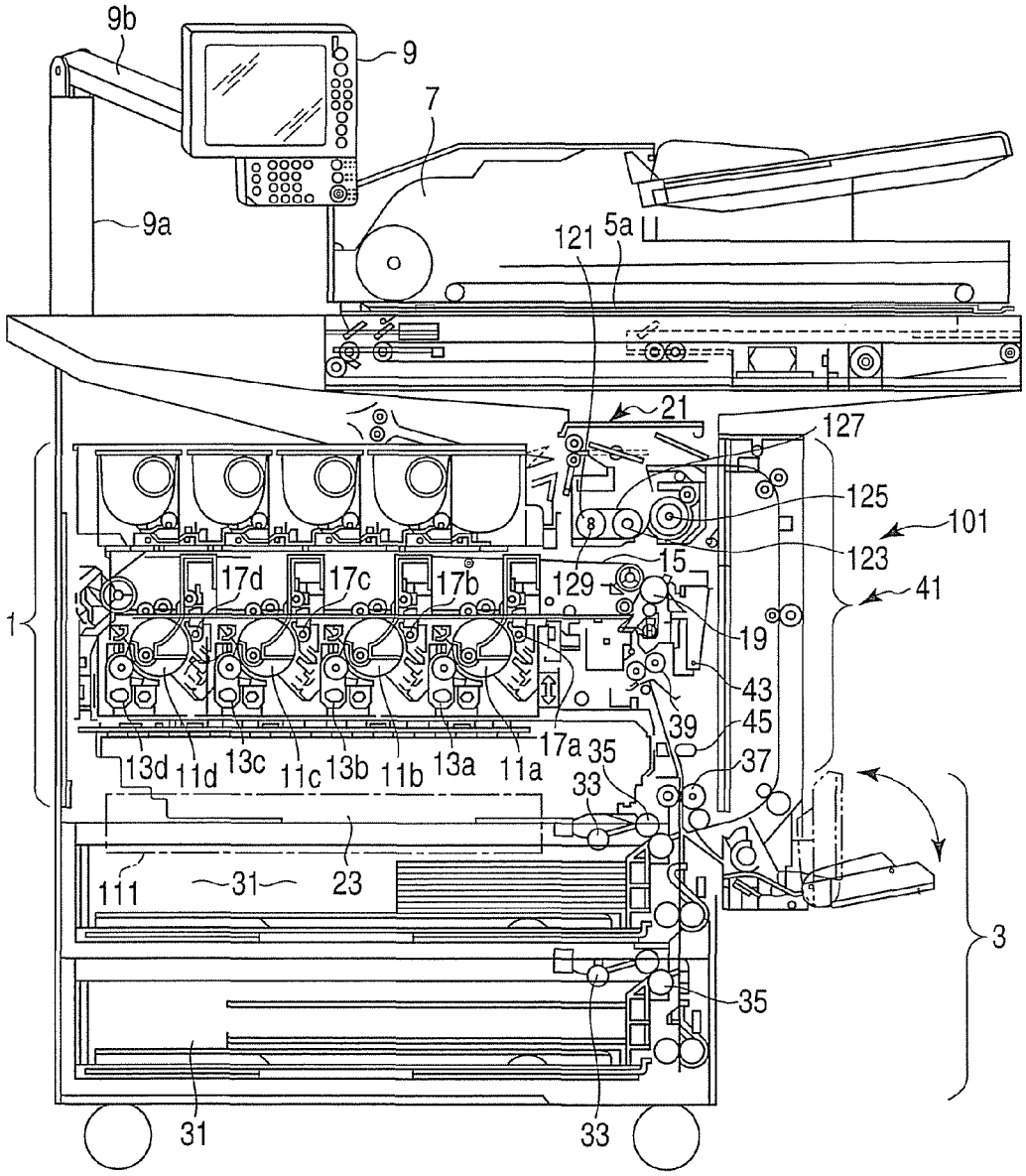
FIG. 1 is an exemplary diagram showing an example of an MFP, according to an embodiment.

An MFP 101 shown in FIG. 1 has an image forming section (a printer section) 1 for outputting image information as an output image which is referred to as a hard copy or a print out, a sheet feeder 3 to supply a sheet medium having an optional size, which is used for an image output, to the image forming section 1, and a scanner section 5 to provide image data of an original to the image forming section 1.

Moreover, the scanner section 5 integrally has an automatically-document feeder (ADF) 7 the original to a reading position on the scanner section 5.

A control panel 9 for giving an instruction for starting image formation in the image forming section 1 and starting to read image information of the original through the scanner section 5 is placed in a strut 9*a* fixed to the image forming section 1 and a swing arm 9*b* in a corner at a left or right side behind the scanner section 5.

The image forming section 1 includes first to fourth photoconductive drums 11*a* to 11*d* for holding latent images, developers 13*a* to 13*d* for supplying a toner to the latent images on the photoconductive drums 11*a* to 11*d* to develop toner images, a transfer belt 15 for holding the toner images transferred from the photoconductive drums 11*a* to 11*d* in order, cleaners 17*a* to 17*d* for cleaning the individual photoconductive drums 11*a* to 11*d*, a transfer roller 19 for transferring the toner image held by the transfer belt 15 onto a sheet medium, a fuser 21 for fixing the toner image transferred to the sheet medium by the transfer roller 19 onto the sheet medium, and an exposing device 23 for forming latent images on the photoconductive drums 11*a* to 11*d*.

The first to fourth developers 13*a* to 13*d* store toners having optional colors of Y (yellow), M (magenta), C (cyan) and Bk (black) which are used for obtaining a color image by a subtractive process and visualize a latent image held by each of the photoconductive drums 11*a* to 11*d* in any of the colors Y, M, C and Bk. The respective colors are determined in predetermined order corresponding to an image forming process or a characteristic of the toner.

The transfer belt 15 holds the toner images having the respective colors which are formed by the first to fourth photoconductive drums 11*a* to 11*d* and the corresponding developers 13*a* to 13*d* in order (of the formation of the toner images).

The sheet feeder 3 supplies the sheet medium to be transferred the toner image by the transfer roller 19.

Cassettes positioned in a plurality of cassette slots 31 store sheet media having optional sizes. Depending on an image forming operation, a pickup roller 33 takes the sheet medium out of the corresponding cassette. The size of the sheet medium corresponds to a size of the toner image formed by the image forming section 1.

A separating mechanism 35 prevents at least two sheet media from being taken out of the cassette by the pickup roller 33.

A plurality of delivery rollers 37 feed the sheet medium separated to be one sheet medium by the separating mechanism 35 toward an aligning roller 39.

The aligning roller 39 feeds the sheet medium to a transfer position in which the transfer roller 19 and the transfer belt 15 come in contact with each other in a timing for transferring the toner image from the transfer belt 15 by the transfer roller 19.

The fuser 21 fixes the toner image corresponding to the image information onto the sheet medium as the output image (hard copy, print out) and feeds the output image to a stocker 47 positioned in a space between the scanner section 5 and the image forming section 1.

The transfer roller 19 is positioned in an automatically-duplex unit (ADU) 41 for replacing both sides of the sheet medium, that is, the output image (hard copy, print out) which has the toner image fixed thereto by the fuser 21.

The ADU 41 moves to a side (a right side) with respect to the image forming section 1, if the sheet medium is jammed between the delivery roller 37 (a final one) and the aligning roller 39 or between the aligning roller 39 and the fuser 21, that is, in the transfer roller 19 or the fuser 21. The ADU 41 integrally has a cleaner 25 for cleaning the transfer roller 19.

A media sensor 45 to detect thickness of the sheet medium conveyed to the aligning roller 39 in the path between the delivery roller 37 and the aligning roller 39. The media sensor 45 useable an optical type benefit of priority from: U.S. patent application Ser. No. 12/197,880 filed on Aug. 25, 2008 and Ser. No. 12/199,424 filed on Aug. 27, 2008 and/or a shift of thickness detecting roller type benefit of priority from: U.S. Provisional Application No. 61/043,801 filed on Apr. 10, 2008, each of which are incorporated.

Figure 2:
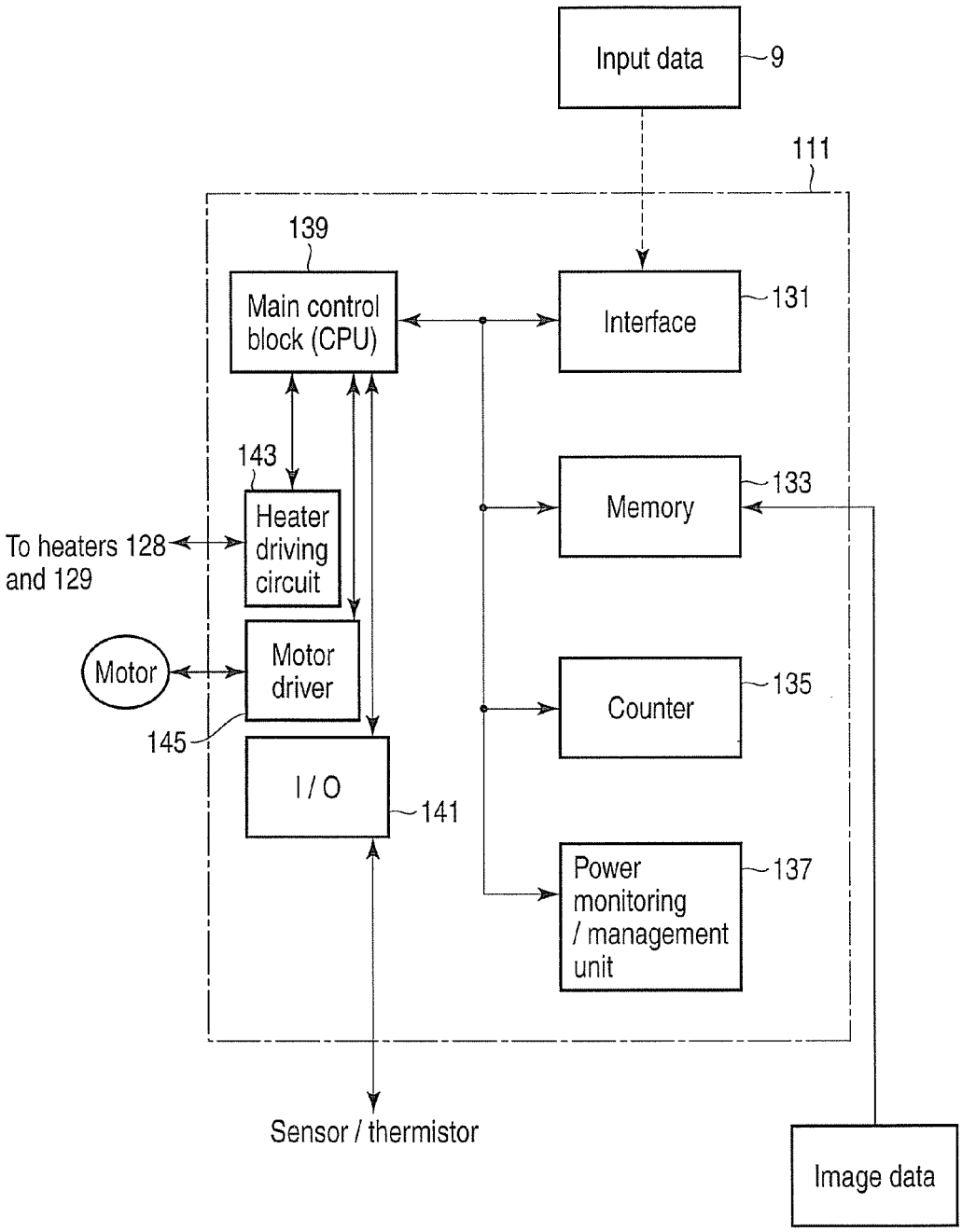
FIG. 2 is an exemplary diagram showing an example of a control section of the MFP, according to an embodiment.

As shown in the example in FIG. 2, a control unit 111 includes an interface 131 which receives input values from the control panel (an operation unit) 9, to which can be input the number of output images (output) corresponding to the image information obtained by the scanner section 5 (and the ADF 7), the magnification of output images, the size of sheet media, a printing start signal, or the like; a memory 133 which stores input numerical value data (input values), a reference table storing the relationship between the ready display and the fusing temperature (of the fuser belt of the fuser 21), and the like; a counter 135 which counts the number of output images on which image formation ends in the image forming section 1; a power monitoring/management unit 137 which refers to the number of remaining output images stored by the counter 135 and obtains utilizable power in order to increase the fusing temperature (of the fuser belt of the fuser 21) up to a fusing temperature (of the fuser 21) at which color images can be output while continuously performing image formation of black-and-white images when, for example, a color image output instruction is issued during the output of black-and-white images, a Main control block (CPU) 139, and the like. The CPU (main control block) 139 controls display that says the fusing by the fuser 21 is possible, and the like in regard to temperature control to be described hereinbelow, image formation in the image forming section 1, color image output and black-and-white image output. In addition, the CPU 139 sets the power which is supplied to a heater (of the fuser 21) from a heater driving circuit 143 in accordance with fusing temperatures (of the fuser belt and the pressure roller of the fuser 21) which are obtained from several temperature sensors (thermistors) through an I/O section 141. The upper limit of the maximum value of the power which can be supplied to the heater is set to the utilizable power obtained by the power monitoring/management unit 137.

Figure 3:
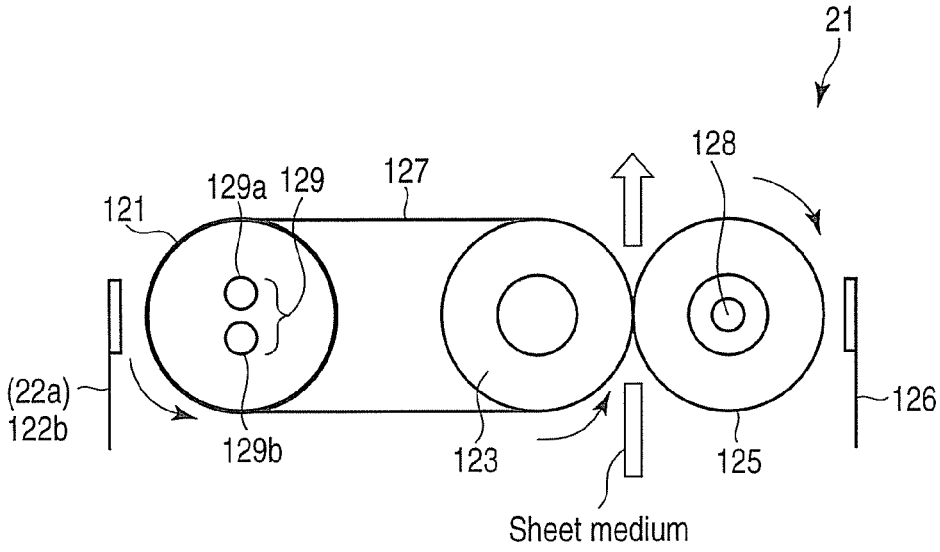
FIG. 3 is an exemplary diagram showing an example of a fuser unit of the MFP, according to an embodiment.
Figure 4:
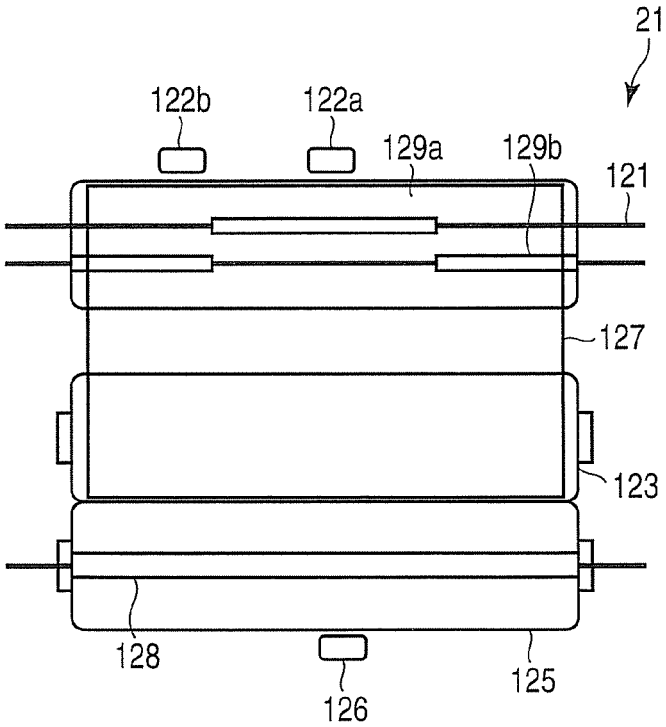
FIG. 4 is an exemplary diagram showing an example of a fuser unit of the MFP, according to an embodiment.

As shown in the examples in FIGS. 3 and 4, the fuser 21 includes a first roller 121, a second roller 123, a third roller 125 and a fuser belt 127 which receives a predetermined tension by the first and second rollers 121 and 123. The first roller 121 is referred to as, for example, a heating roller. The second roller 123 is referred to as a fuser roller. The third roller 125 is referred to as a pressure roller.

An arbitrary part of the fuser belt 127 and the outer circumference of the pressure roller 125 form a nip due to pressure which is applied to the fuser roller 123 and the pressure roller 125. Therefore, a predetermined pressure and a temperature (fusing temperature) at which toner can be dissolved are applied to a sheet medium passing through the nip, so that the toner (toner image) held by the sheet medium can be fixed.

Any of the heating roller 121, the fuser roller 123 and the pressure roller 125 is rotated at a certain speed through a motor 21*a* rotating by a predetermined rotation amount in accordance with the control of a motor driver 145 (see FIG. 2). The motor 21*a* rotates at the time when the fusing temperature (of the fuser belt of the fuser 21) reaches a certain temperature (and during fusing operation). Therefore, an arbitrary position in the fuser belt 127 moves in a direction perpendicular to a rotational axis (of the fuser roller 123) at a certain speed which is the speed at which a sheet medium moves. The motor 21*a* rotates, for example, the heating roller 121. However, it can also rotate the pressure roller 125. The motor 21*a* can also rotate the fuser roller 123.

The heating roller 121 has a diameter of, for example, 30 mm, and as an example, a heater (heating element or heating device) 129 is included therein. The heater 129 may be a lamp, a resistance wire or the like. The heater 129 may be positioned outside the fuser belt 127 along the outer circumference of the fuser belt 127. The heating roller 121 is provided with a tube made of aluminum formed at a thickness of 0.8 mm, and a tetrafluoroethylene resin or a fluorine resin is preferably disposed as a releasing layer on the surface thereof.

The fuser roller 123 has a diameter of, for example, 38 mm, and an elastic body having a predetermined thickness such as silicon rubber is preferably disposed around the axis thereof.

The pressure roller 125 has a diameter of, for example, 40 mm. An elastic body having a predetermined thickness such as rubber having hardness higher than that of the elastic body which is used in the fuser roller 123 is preferably disposed around the axis thereof, and the surface thereof is preferably coated with a releasing layer formed of a tetrafluoroethylene resin or a fluorine resin. The pressure roller 125 further includes a heater (heating element or heating device) 128 therein. The output of the heater 128 may be ½ to ¼ of the output of the heater 129 which is used in the heating roller 121.

As an example, the fuser belt 127 is provided with an elastic body such as silicon rubber having a predetermined thickness, and a releasing layer formed of a tetrafluoroethylene resin or a fluorine resin is preferably disposed on the surface thereof (surface on the side coming into contact with the pressure roller 125). The elasticity of silicon rubber is preferably either the same hardness as the hardness of the elastic body which is used in the fuser roller 123 or softer. In addition, if necessary, a reinforcing member which is formed of a sheet-like metal (metal film) or the like may be provided on the back surface thereof (surface on the side coming into contact with the fuser roller 123).

As shown in the example in FIG. 4, the heater 129 (on the side of the heating roller 121) includes first and second heater lamps 129*a* and 129*b* with the heating regions thereof differentiated in the longitudinal direction of the heating roller 121. The heating region of one lamp is almost at the center in the longitudinal direction of the heating roller 121. In terms of the position in the longitudinal direction of the heating roller 121, the heating region of the other lamp does not match the heating region in which the one lamp generates heat and preferably starts from both ends of the heating roller 121. The heater lamps 129*a* and 129*b* are preferably halogen lamps. In addition, the output of the heater lamps 129*a* and 129*b* is generally 600 W and is preferably two to four times the output of the heater 128 included in the heating roller 125.

The output of each of the lamps (heaters) is controlled in accordance with the temperatures, which are detected by thermistors (temperature sensors) 122*a* and 122*b* with the fuser belt 127 interposed therebetween, at two points which are around the center and the end in the longitudinal direction of the heating roller 121, the temperature which is detected by a thermistor 126 measuring the temperature around the center in the longitudinal direction of the pressure roller 125, the allowable maximum supply power that the power monitoring/management unit 137 permits, and the output value of the heater driving circuit 143 which is set by the CPU 139.

Figure 16:
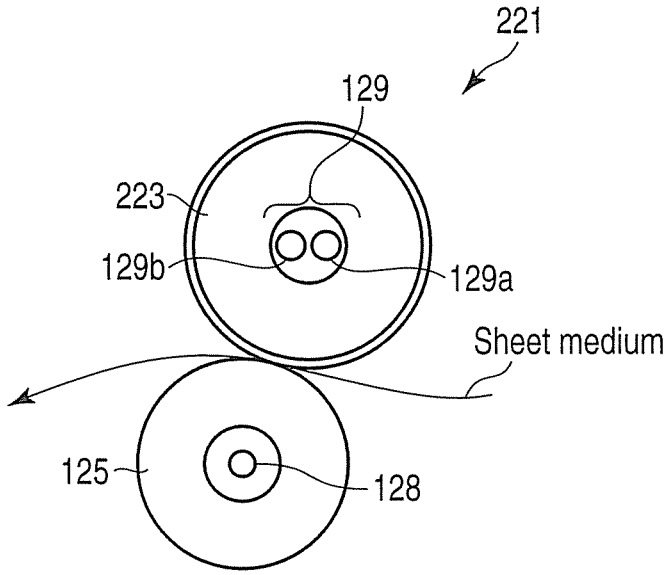
FIG. 16 is an exemplary diagram showing an example of a fuser of the MFP, according to an embodiment.

As shown in FIG. 16, it is also possible to use a fuser 221 in which without using the fuser belt, a fuser roller 223 is provided with a heater (heating mechanism) 229 and is positioned to come into direct contact with the pressure roller 125. As in the exemplary heating roller 121 shown in FIG. 4, the heater 129 preferably includes first and second heater lamps 129*a* and 129*b* with the heating regions thereof differentiated in the longitudinal direction of the fuser roller 223.

Figure 17:
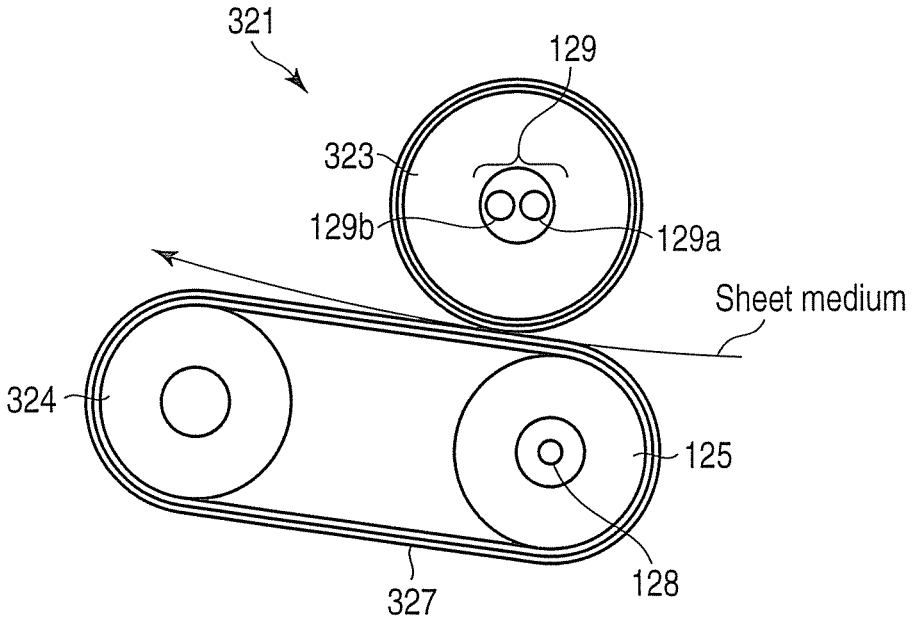
FIG. 17 is an exemplary diagram showing an example of a fuser of the MFP, according to an embodiment) is an exemplary diagram showing an example of an MFP according to an embodiment.

In addition, as shown in FIG. 17, it is also possible to use a fuser 321 in which without using the fuser belt, the fuser roller 223 (with the heater 129 inserted therein) shown in FIG. 16 is provided, an auxiliary roller 324 is provided on the side of the pressure, roller 125 and a fuser belt 327 is used to which a predetermined tension is given by the auxiliary roller 324 and a pressure roller 325.

Figure 5:
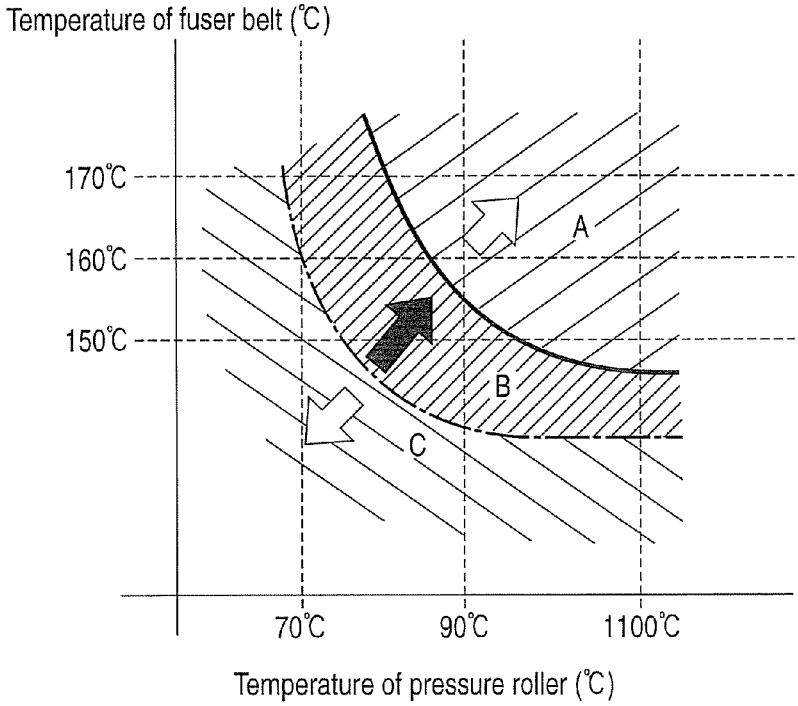
FIG. 5 is an exemplary diagram showing an example of a temperature environment (fusing temperature conditions) of the fuser of the MFP, according to an embodiment.

FIG. 5 shows an example of the temperature of fuser belt (heating roller), the temperature of pressure roller, and the conditions of occurrence of the result of fusing which is not preferred, for example, fusing offset.

The toners which are used in the MFP 101 are a black (Bk) toner which is used in the output of black-and-white (B/W) images, and cyan (C), magenta (M) and yellow (Y) toners which are used in the output of color images.

Each of melting points of the Bk toner for black and white (B/W) image, C toner, M toner and Y toner for color images are same. However, the toner amount (thickness) of the color image is lager (thick) than the Bk toner (B/W image). Accordingly, when an output image is only a B/W image, the lower limit temperatures when warming-up allowing the rise of the temperatures of the fuser belt, the heating roller and the pressure roller up to certain temperatures is completed can be set to be lower than those when color images are formed. In contrast, the lower limit temperatures when warming-up allowing the rise of the temperatures of the fuser belt, the heating roller and the pressure roller up to determine can be set to be lower than those when color images are formed.

In FIG. 5, when the temperatures of both of the fuser belt (heating roller) and the pressure roller are sufficiently high and in the region indicated by the symbol A, there is no occurrence of fusing offset in the color image output and the B/W image output.

In FIG. 5, when the temperatures of both of the fuser belt (heating roller) and the pressure roller are still increasing or lowered up to temperatures at which fusing offset may occur due to the repeated image output and are thus in the region indicated by the symbol C, waiting is required until the temperatures of the fuser belt (heating roller) and the pressure roller increase regardless of the color image output and the B/W image output.

In FIG. 5, when the temperatures of both of the fuser belt (heating roller) and the pressure roller are still increasing or lowered to some degrees due to the repeated image output and are thus in the region indicated by the symbol B, there is concern that fusing offset may occur in the color image output, but in the B/W image output, fusing offset does not occur substantially.

Figure 14:
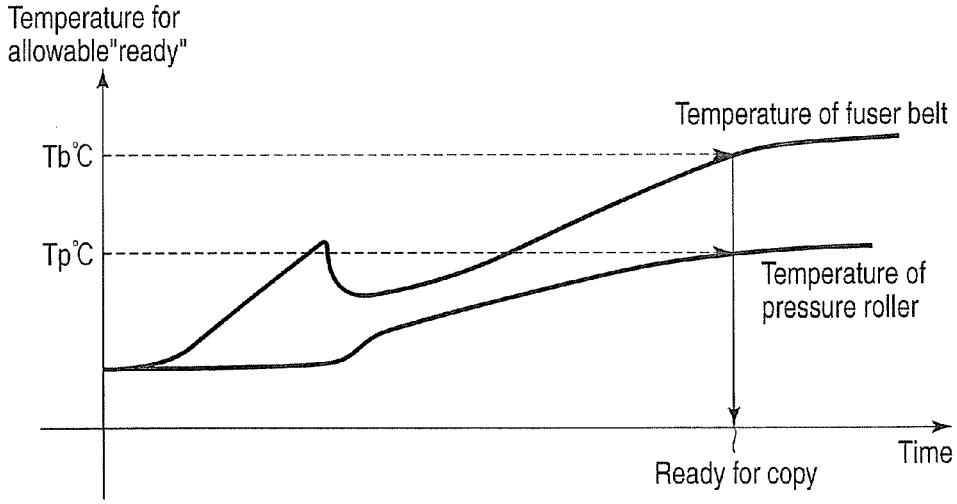
FIG. 14 is an exemplary diagram showing an example of conventional fusing temperatures (fuser belt temperature and pressure roller temperature) of the fuser, according to an embodiment.

That is, the drawing shows that when the image output required of the MFP 101 is B/W image output, except for image output using only an arbitrary color different from the Bk toner which is referred to as a mono color, printout is possible even during the period in which the temperatures of the fuser belt (heating roller) and the pressure roller are increasing to temperatures at which color images can be output. Accordingly, during the warming-up operation from immediately after power-on of the main power source of the MFP 101 to when the ready state is reached, during the temperature control for recovery from the sleep (power saving) mode, during the waiting until the temperatures of the fuser belt (heating roller) and the pressure roller increase resulting from the repeated image output, or in other cases, when a printing request relates to the B/W image output, the waiting time until the image output is possible in the temperature control (up to a temperature at which color images can be output) of which the detailed example is shown in FIG. 14 and which is currently widely employed can be reduced.

Figure 6:
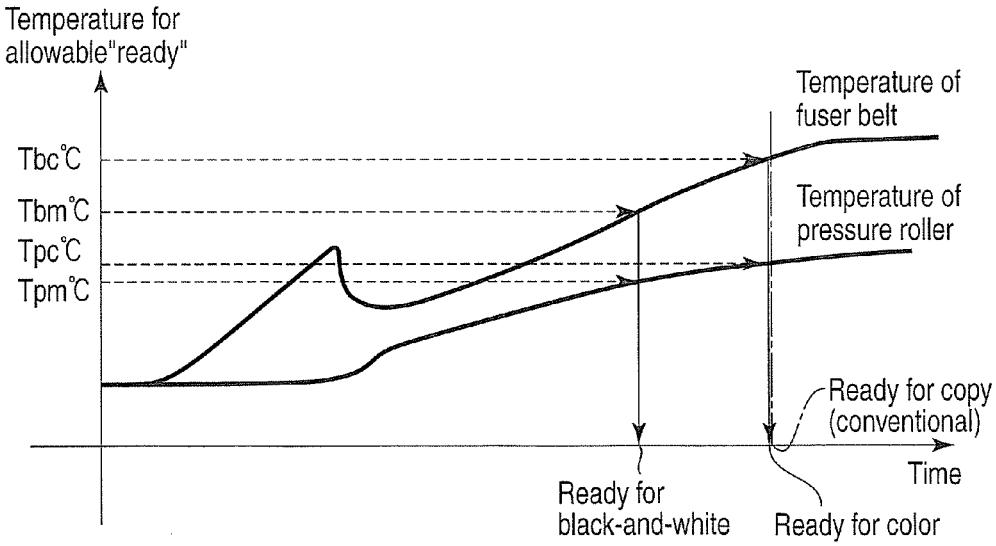
FIG. 6 is an exemplary diagram showing an example of fusing temperatures (fuser belt temperature and pressure roller temperature) of the fuser, according to an embodiment.

For example, as shown in FIG. 6, when predetermined power is given to the heaters 129 (fuser belt (heating roller)) and 128 (pressure roller), the temperature of the fuser belt 127 (heating roller 121) is temporarily lowered at the time when a pre-running for solving the temperature variation of the fuser belt and the pressure roller is started, and then the temperatures of the fuser belt 127 (heating roller 121/fuser roller 123) and the pressure roller 125 pass through temperatures Tbm (fuser belt) and Tpm (pressure roller) both of for allowable "Ready for B/W image" at which B/W images can be formed (fusing without the occurrence of fusing offset) while the temperatures gradually increase. These temperatures are lower than temperatures Tbc (fuser belt) and Tpc (pressure roller) both of for allowable "Ready for color image" at which color images can be output. Accordingly, when a printing request relates to the B/W image output and only a B/W images is output, the waiting time up to the start of image output (printout) can be reduced. In FIG. 6, the temperatures Tbc (fuser belt) and Tpc (pressure roller) at which color images can be output show general temperature control not making the distinction between the B/W image output and the color image output, and it is obvious that when only a B/W image is output, the waiting time (time t) is reduced.

Figure 7:
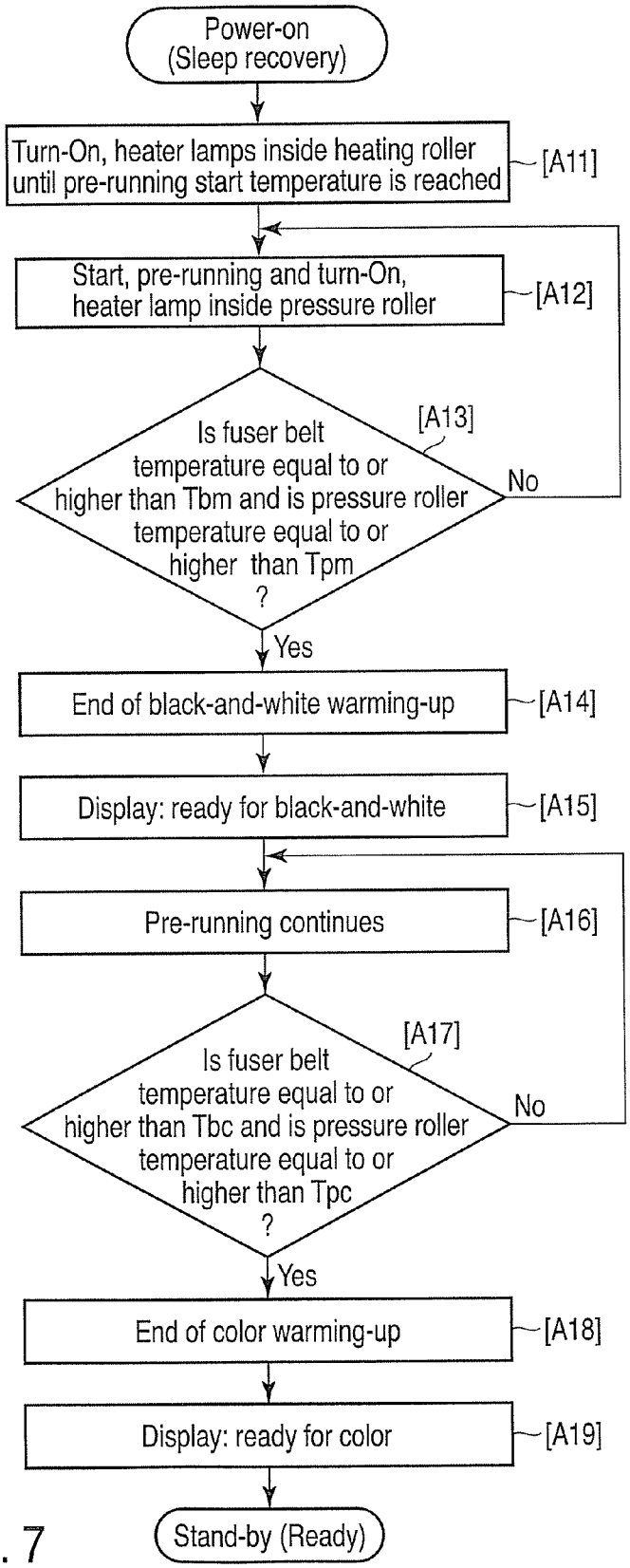
FIG. 7 is an exemplary diagram showing an example of temperature control of the fuser, according to an embodiment.

In detail, as shown in FIG. 7, the heater 129 (129*a* and 129*b*) inside of the heating roller 121 is turned-on, and operated with the upper limit power set by the power monitoring/management unit 137 to heat the fuser belt 127 (heating roller 121) until a pre-running start temperature is reached [A11].

When the pre-running for solving the temperature variation of the fuser belt 127 and the pressure roller 125 is started [A12], the temperature of the fuser belt 127 (heating roller 121) is temporarily lowered. Accordingly, the heating (temperature increasing) by the heater 129 continues during the period up to when the temperatures Tbm (fuser belt) and Tpm (pressure roller) both of for allowable "Ready for B/W image" at which B/W images can be formed (fusing without the occurrence of fusing offset) are reached [A13].

When the temperature of the fuser belt 127 reaches Tbm and the temperature of the pressure roller 125 reaches Tpm [A13-Y], in the CPU 139, the end of B/W warming-up allowing the formation of B/W images is detected [A14] and a display region in the control panel 9 displays a display that provides notification that the temperatures of the fuser belt and the pressure roller increase up to temperatures at which image formation not for the case of color image output is possible, such as "B/W image can be output" [A15].

Next, the pre-running continues [A16] and the heating (temperature increasing) by the heater 129 continues during the period up to when the temperatures of the fuser belt 127 (heating roller 121) and the pressure roller 125 reach the temperatures Tbc (fuser belt) and Tpc (pressure roller) both of for allowable "Ready for color image" at which color images can be formed [A17].

When the temperature of the fuser belt 127 reaches Tbc and the temperature of the pressure roller 125 reaches Tpc [A17-Y], in the CPU 139, the end of (color) warming-up allowing the formation of images regardless of the image kinds is detected [A18], the display region in the control panel 9 displays a display that provides notification that the temperatures of the fuser belt and the pressure roller increase up to temperatures at which arbitrary image formation including the color image output is possible, such as "All of images can be output" [A19], and the process advances to the temperature control of the waiting state (ready state).

As described above, a user who tries to output only a B/W image can be notified of the minimum necessary time up to the completion of warming-up.

Figure 8:
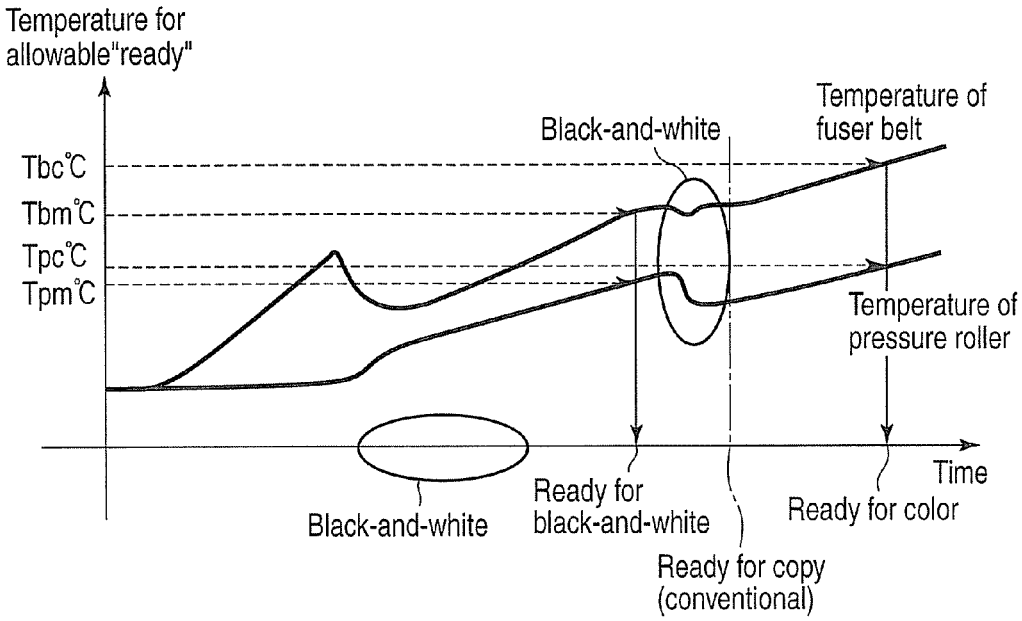
FIG. 8 is an exemplary diagram showing an example of fusing temperatures (fuser belt temperature and pressure roller temperature) of the fuser, according to an embodiment.
Figure 10:
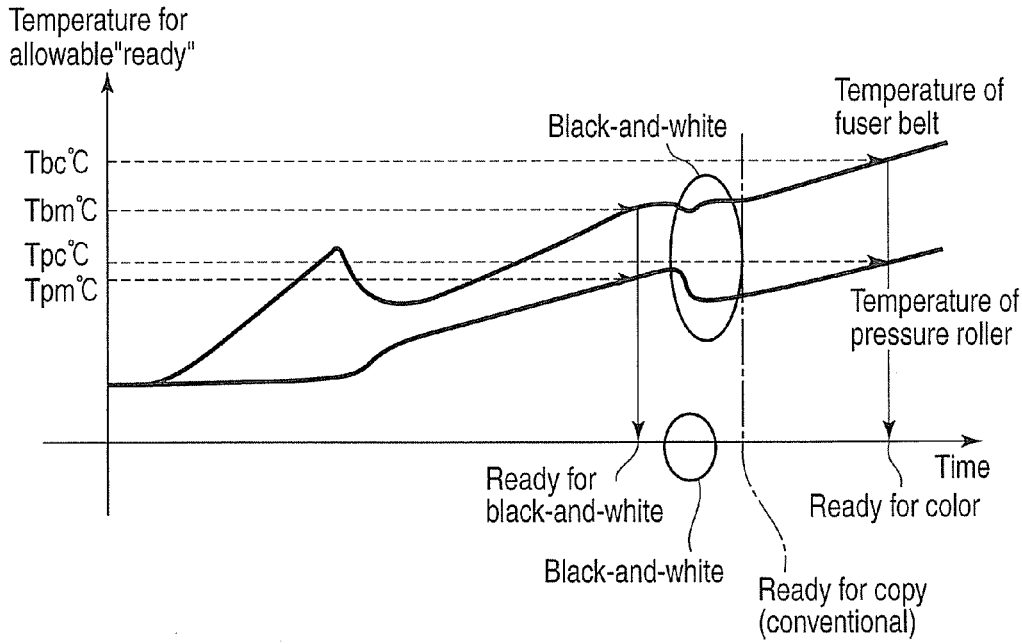
FIG. 10 is an exemplary diagram showing an example of fusing temperatures (fuser belt temperature and pressure roller temperature) of the fuser, according to an embodiment.
Figure 15:
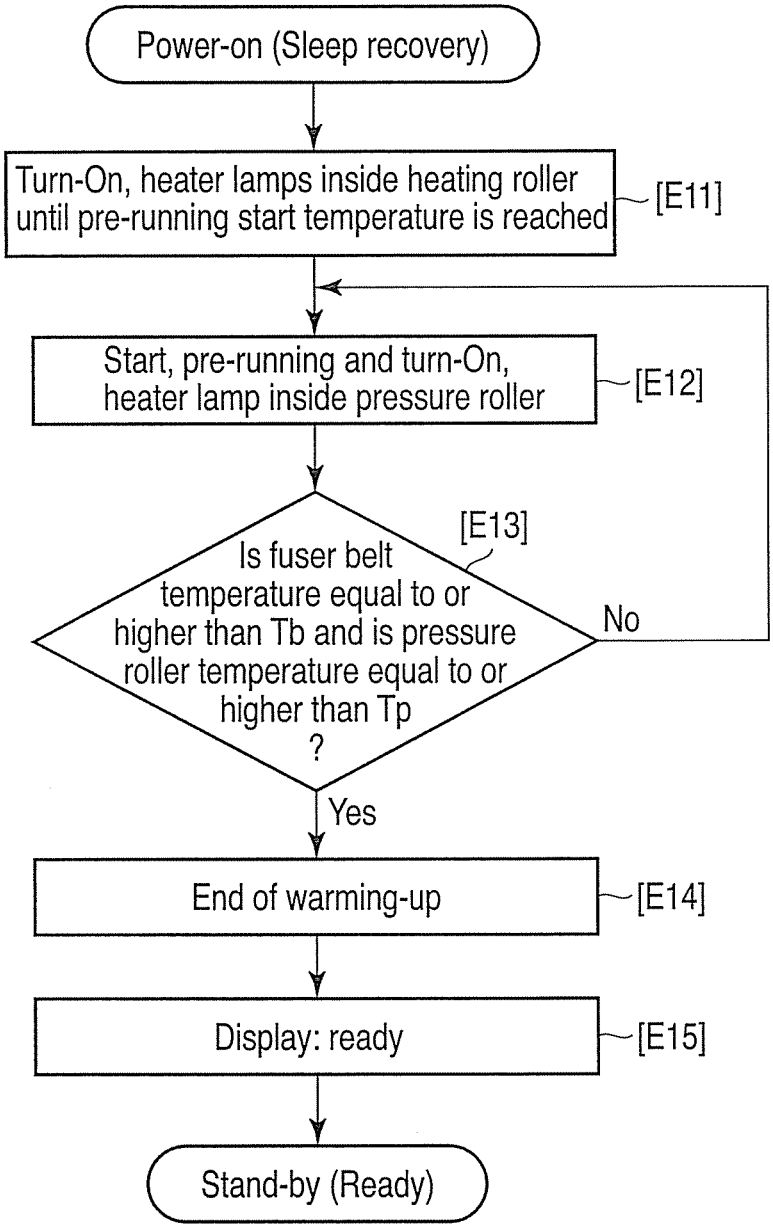
FIG. 15 is an exemplary diagram showing an example of conventional temperature control of the fuser, according to an embodiment.

According to the example shown in FIG. 6, when a B/W image is actually output during the temperature control (up to a temperature at which color images can be output), as shown in, for example, FIG. 8 or 10, the time which is required up to the completion of warming-up allowing the output of color images is longer than the waiting time until the image output is possible in the temperature control (up to the temperature at which color images can be output) of which the detailed example is shown in FIG. 14 and the outline is shown in FIG. 15 and which is currently widely employed.

However, there is no instruction for image formation after the output of the B/W image (there is no next job), the effect up to the completion of warming-up allowing the output of all the kinds of images due to the priority given to the output of B/W images is not large. FIG. 8 shows the operation (temperature change) when there is a B/W image output request (printing request) during the period up to when the temperatures Tbm (fuser belt) and Tpm (pressure roller) both of for allowable "Ready for B/W image" at which B/W images can be output are reached, and FIG. 10 shows the operation (temperature change) when there is a B/W image output request (printing request) during the period between when the temperatures Tbm (fuser belt) and Tpm (pressure roller) both of for allowable "Ready for B/W image" at which B/W images can be output are reached and when the temperatures Tbc (fusing belt) and Tpc (pressure roller) both of for allowable "Ready for color image" at which color images can be output are reached. In the example of FIG. 8 or 10, as a result, the waiting time increases from the point of view of a user who outputs a color image. Accordingly, the heating by the heaters 129 (fuser belt) and 128 (pressure roller) continues up to a temperature at which arbitrary image formation including the color image output is possible.

Figure 9:
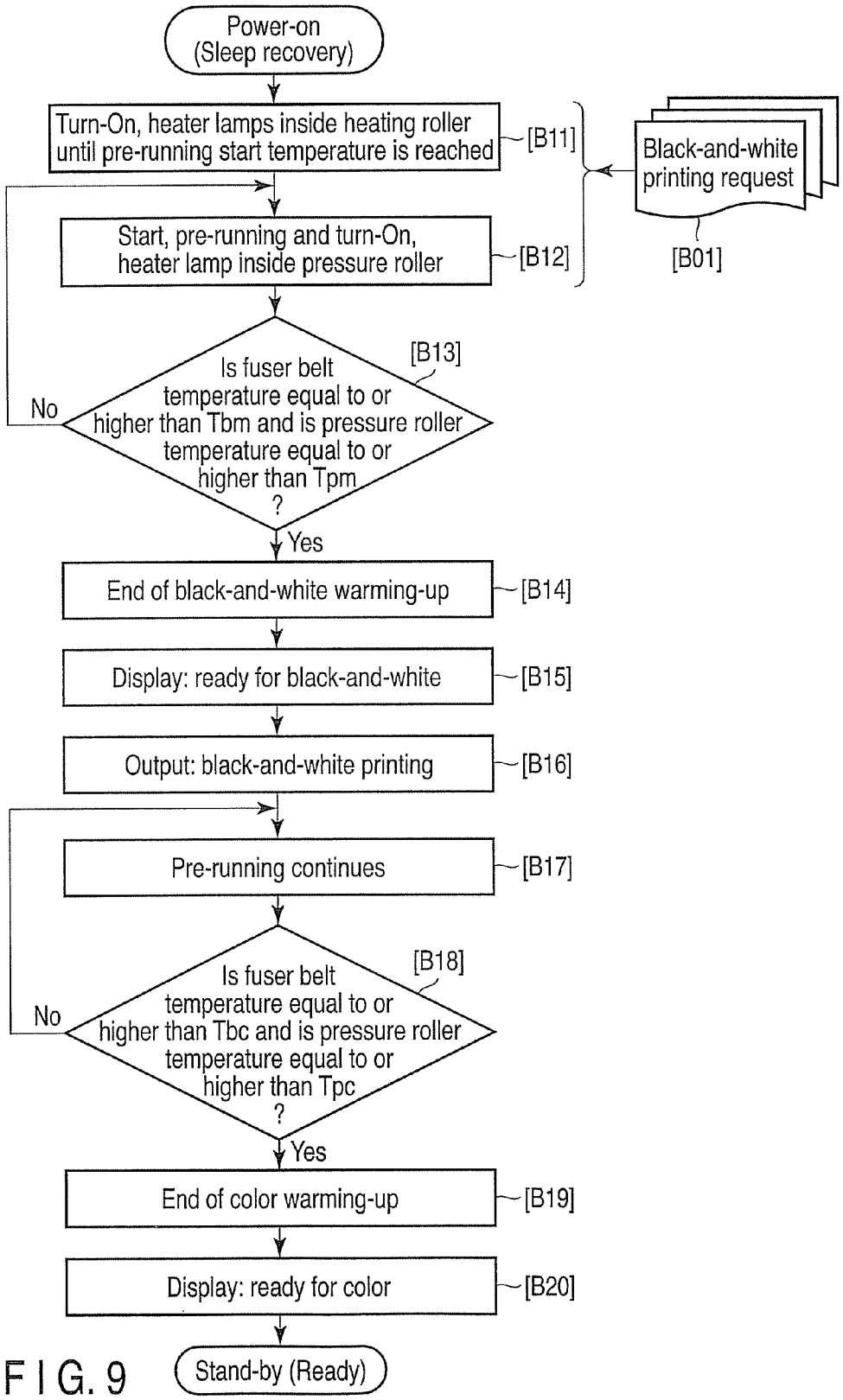
FIG. 9 is an exemplary diagram showing an example of temperature control of the fuser, according to an embodiment.

In greater detail, when there is a B/W image output request [B01] during the period up to when the temperatures Tbm (fuser belt) and Tpm (pressure roller) at which B/W images can be output are reached, as shown in FIG. 9, the heater 129 (129*a*, 129*b*) inside of the heating roller 121 is turned-on, and operated with the upper limit power set by the power monitoring/management unit 137 to heat the fuser belt 127 (heating roller 121) until a pre-running start temperature is reached [B11]. When the pre-running for solving the temperature variation of the fuser belt 127 and the pressure roller 125 is started [B12], the temperature of the fuser belt 127 (heating roller 121) is temporarily lowered. Accordingly, the heating (temperature increasing) by the heater 129 continues during the period up to when the temperatures Tbm (fuser belt) and Tpm (pressure roller) both of for allowable "Ready for B/W image" at which B/W images can be formed (fusing without the occurrence of fusing offset) are reached [B13].

When the temperature of the fuser belt 127 reaches Tbm and the temperature of the pressure roller 125 reaches Tpm [B13-Y], in the CPU 139, the end of B/M warming-up allowing the formation of B/W images is detected [B14] and the display region in the control panel 9 displays a display that provides notification that the temperatures of the fuser belt and the pressure roller increase up to temperatures at which image formation not for the case of color image output is possible, such as "B/W image can be output" [B15].

Then, the B/W image formation which is requested by [B01] is carried out [B16].

Next, the pre-running continues [B17] and the heating (temperature increasing) by the heater 129 continues during the period up to when the temperatures of the fuser belt 127 (heating roller 121) and the pressure roller 125 reach the temperatures Tbc (fuser belt) and Tpc (pressure roller) both of for allowable "Ready for color image" at which color images can be formed [B18].

When the temperature of the fuser belt 127 reaches Tbc and the temperature of the pressure roller 125 reaches Tpc [B18-Y], in the CPU 139, the end of (color) warming-up allowing the formation of images regardless of the image kinds is detected [B19], the display region in the control panel 9 displays a display that provides notification that the temperatures of the fuser belt and the pressure roller increase up to temperatures at which arbitrary image formation including the color image output is possible, such as "All of images can be output" [B20], and the process advances to the temperature control of the waiting state (ready state).

Accordingly, a B/W image can be output to a user who requests output only of a B/W image in the minimum necessary waiting time during the period up to when the warming-up is completed, and a user who tries to output a color image can also be notified of the completion of warming-up in the minimum necessary time.

Figure 11:
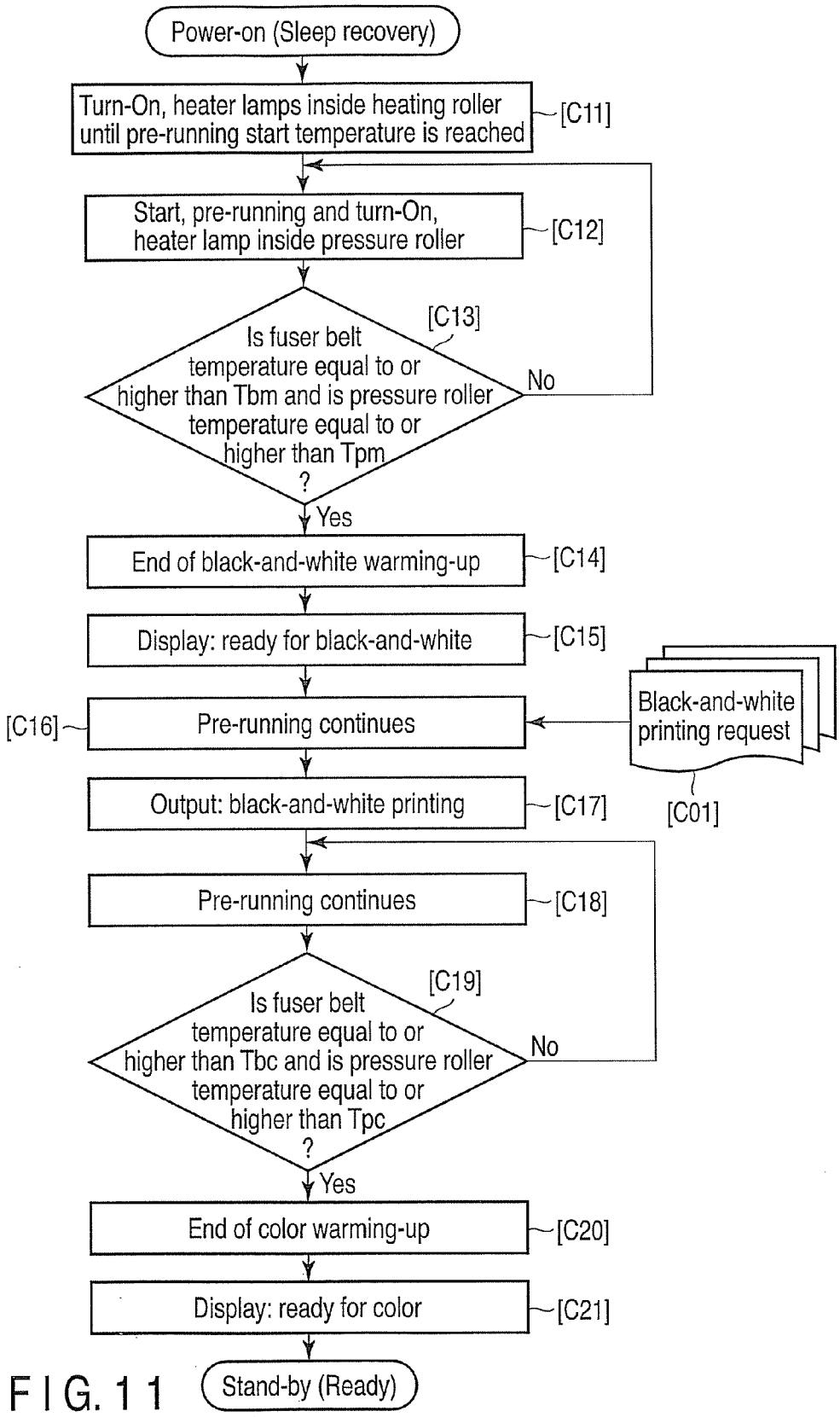
FIG. 11 is an exemplary diagram showing an example of temperature control of the fuser, according to an embodiment.

In addition, when there is a B/W image output request [C01] during the period between when the temperatures Tbm (fuser belt) and Tpm (pressure roller) at which B/W images can be output are reached and when the temperatures Tbc (fuser belt) and Tpc (pressure roller) at which color images can be output are reached, as shown in FIG. 11, the heater 129 (129*a*, 129*b*) inside of the heating roller 121 is turned-on, and operated with the upper limit power set by the power monitoring/management unit 137 to heat the fuser belt 127 (heating roller 121) until a pre-running start temperature is reached [C11]. When the pre-running for solving the temperature variation of the fuser belt 127 and the pressure roller 125 is started [C12], the temperature of the fuser belt 127 (heating roller 121) is temporarily lowered. Accordingly, the heating (temperature increasing) by the heater 129 continues during the period up to when the temperatures Tbm (fuser belt) and Tpm (pressure roller) both of for allowable "Ready for B/W image" at which B/W images can be formed (fusing without the occurrence of fusing offset) are reached [C13].

When the temperature of the fuser belt 127 reaches Tbm and the temperature of the pressure roller 125 reaches Tpm [C13-Y], in the CPU 139, the end of B/M warming-up allowing the formation of B/W images is detected [C14] and the display region in the control panel 9 displays a display that provides notification that the temperatures of the fuser belt and the pressure roller increase up to temperatures at which image formation not for the case of color image output is possible, such as "B/W image can be output" [C15].

Next, the pre-running continues [C16] and the B/W image formation which is requested by [C01] is carried out [C17] when there is the B/W image output request [C01].

The pre-running continues [C18] and the heating (temperature increasing) by the heater 129 continues during the period up to when the temperatures of the fuser belt 127 (heating roller 121) and the pressure roller 125 reach the temperatures Tbc (fuser belt) and Tpc (pressure roller) both of for allowable "Ready for B/W image" at which color images can be formed [C19].

When the temperature of the fuser belt 127 reaches Tbc and the temperature of the pressure roller 125 reaches Tpc [C19-Y], in the CPU 139, the end of (color) warming-up allowing the formation of images regardless of the image kinds is detected [C20], the display region in the control panel 9 displays a display that provides notification that the temperatures of the fuser belt and the pressure roller increase up to temperatures at which arbitrary image formation including the color image output is possible, such as "All of images can be output" [C21], and the process advances to the temperature control of the waiting state (ready state).

Accordingly, a B/W image can be output to a user who requests output only of a B/W image in the minimum necessary waiting time during the period up to when the warming-up is completed, and a user who tries to output a color image can also be notified of the completion of warming-up in the minimum necessary time.

Figure 12:
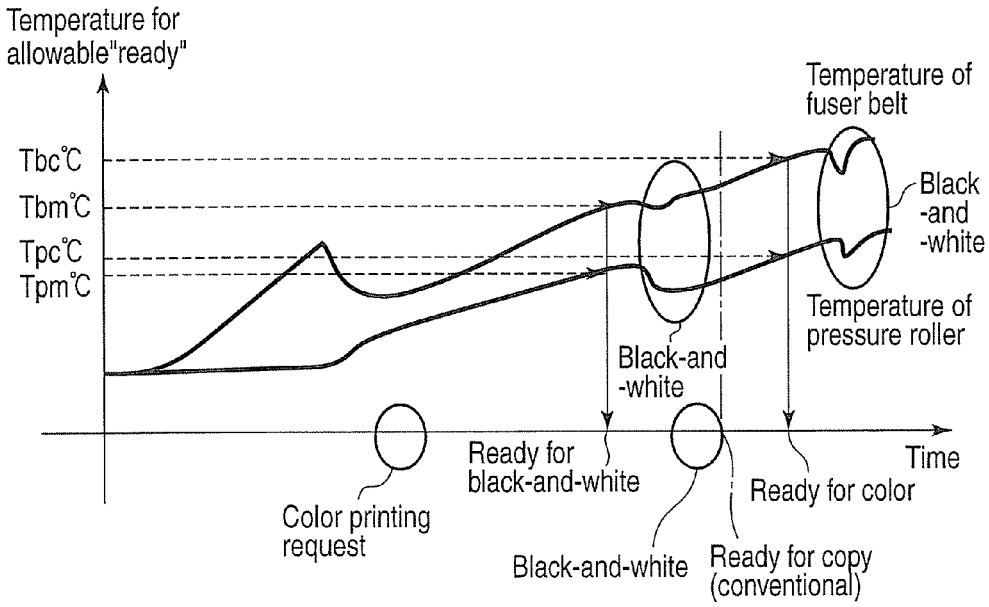
FIG. 12 is an exemplary diagram showing an example of fusing temperatures (fuser belt temperature and pressure roller temperature) of the fuser, according to an embodiment.

As described above, according to the example shown in FIG. 6, when a B/W image is actually output during the temperature control (up to a temperature at which color images can be output), as shown in FIG. 12 (FIG. 8 or 10), the time which is required up to the completion of warming-up allowing the output of color images is longer than the waiting time until the image output is possible in the temperature control (up to the temperature at which color images can be output) of which the detailed example is shown in FIG. 14 and which is currently widely employed.

In addition, for example, when the B/W image output is requested after request of the color image output during the period from immediately after the start of warming-up to when the temperatures Tbm (fuser belt) and Tpm (pressure roller) at which B/W images can be output are reached, as shown in FIG. 12, it is possible to output an image to a user who requests output only of a B/W image in the minimum necessary waiting time by giving priority to the output of B/W images in accordance with, for example, the number of B/W output images. In addition, in many cases, since a user who tries to output a color image knows that the waiting time may increase easily, giving priority to the print job of a user who requests output only of a B/W image is a great advantage.

Figure 13:
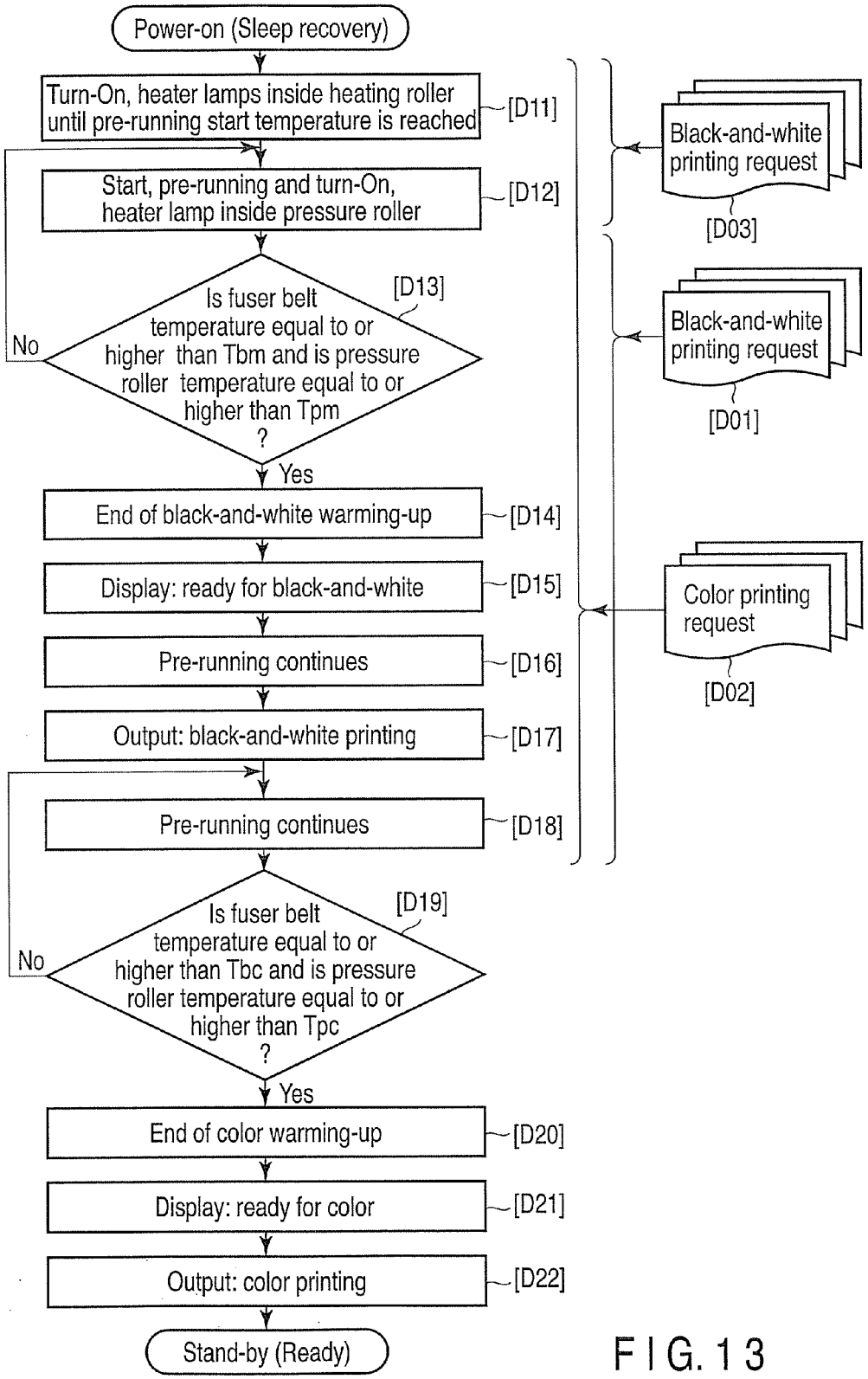
FIG. 13 is an exemplary diagram showing an example of temperature control of the fuser, according to an embodiment.

For example, when there is a color image request [Dc01] during the period up to when the temperatures Tbm (fuser belt) and Tpm (pressure roller) at which B/W images can be output are reached, and there are B/W image output requests [Dm01] and [Dm02] during the period between when the temperatures Tbm (fuser belt) and Tpm (pressure roller) at which B/W images can be output are reached and when the temperatures Tbc (fuser belt) and Tpc (pressure roller) at which color images can be output are reached or during the period up to when the temperatures Tbm (fuser belt) and Tpm (pressure roller) both of for allowable "Ready for B/W image" at which B/W images can be output are reached, as shown in FIG. 13, the heater 129 (129*a* and 129*b*) inside of the heating roller 121 is turned-on, and operated with the upper limit power set by the power monitoring/management unit 137 to heat the fuser belt 127 (heating roller 121) until a pre-running start temperature is reached [D11]. When the pre-running for solving the temperature variation of the fuser belt 127 and the pressure roller 125 is started [D12], the temperature of the fuser belt 127 (heating roller 121) is temporarily lowered. Accordingly, the heating (temperature increasing) by the heater 129 continues during the period up to when the temperatures Tbm (fuser belt) and Tpm (pressure roller) at which B/W images can be formed (fusing without the occurrence of fusing offset) are reached [D13].

When the temperature of the fuser belt 127 reaches Tbm and the temperature of the pressure roller 125 reaches Tpm [D13-Y], in the CPU 139, the end of B/M warming-up allowing the formation of B/W images is detected [D14] and the display region in the control panel 9 displays a display that provides notification that the temperatures of the fuser belt and the pressure roller increase up to temperatures at which image formation not for the case of color image output is possible, such as "B/W image can be output" [D15].

Next, the pre-running continues [D16] and the B/W image formation which is requested by [Dm01] is carried out [D17] when there is the B/W image output request [Dm01].

The pre-running continues [D18] and the heating (temperature increasing) by the heater 129 continues during the period up to when the temperatures of the fuser belt 127 (heating roller 121) and the pressure roller 125 reach the temperatures Tbc (fuser belt) and Tpc (pressure roller) both of for allowable "Ready for color image" at which color images can be formed [D19].

When the temperature of the fuser belt 127 reaches Tbc and the temperature of the pressure roller 125 reaches Tpc [D19-Y], in the CPU 139, the end of (color) warming-up allowing the formation of images regardless of the image kinds is detected [D20], the display region in the control panel 9 displays a display that provides notification that the temperatures of the fuser belt and the pressure roller increase up to temperatures at which arbitrary image formation including the color image output is possible, such as "All of images can be output" [D21], the color image requested by [Dc01] is output [D22] and the process advances to the temperature control of the waiting state (ready state).

In addition, during the period up to when the temperatures Tbm (fuser belt) and Tpm (pressure roller) at which B/W images can be output are reached, the output of the B/W image requested by [Dm02] precedes the output of the B/W image requested by [Dm01] at the time when the end of B/W warming-up allowing the formation of B/W images can be detected [D14] in the CPU 139 as in [B01] shown in FIG. 9.

Accordingly, for example, when the B/W image output is requested after request of the color image output during the period up to when the warming-up is completed, a B/W image can be output to a user who requests output only of a B/W image in the minimum necessary waiting time, and a user who tries to output a color image can also be notified of the completion of warming-up in the minimum necessary time.

On the other hand, when the number of B/W output images requested after request of the color image output is large, the necessary time which is required to output color images increases. Accordingly, the number of B/W output images, which can be placed ahead of the output of color images in [D17], may be limited to, for example, five or less.

At the time when the temperatures Tbm (fuser belt) and Tpm (pressure roller) at which the B/W images can be output are reached, when the B/W image output is carried out, but for example, when a sheet medium has a large thickness, it should be considered that the fusing ratio (fusing stability) is lowered although fusing offset does not occur. For example, when the thickness of paper (sheet medium) (which is detected by the media sensor 45) is larger than a certain thickness, the image output can be permitted at the time when the temperatures Tbc (fuser belt) and Tpc (pressure roller) at which all of the images can be output are reached even when an instruction for the image output only of B/W images is issued.

FIG. 15 shows the outline corresponding to the temperature control shown in FIG. 14 and shows an example in which the detection of the temperatures Tbm (fuser belt) and Tpm (pressure roller) at which B/W images can be output and the output of B/W images are excluded from the image output, illustrated by FIG. 7, when an instruction for the image output only of B/W images is issued.

Here, TABLE 1 shows examples of the measurement of a time for recovery from the sleep state where power consumption is reduced than in the ready state to the ready state in which the temperatures Tbc (fuser belt) and Tpc (pressure roller) at which image output of color images is possible as well as image output only of B/W images are reached by changing the thickness of paper (sheet medium) by using FIG. 15 (corresponding to the temperature control of FIG. 14) and FIG. 7 (corresponding to the temperature control of FIG. 6).

TABLE 1

| Kind of output image | Paper thickness ($g/m^2$) | Time up to recovery to ready state (s) |
|---|---|---|
| W/B | 64 | 58.3 |
| W/B | 80 | 61.8 |
| W/B | 105 | 67.8 |
| Color | 64 | 61.8 |
| Color | 80 | 67.8 |
| Color | 105 | 71.4 |

Referring to TABLE 1, when the paper (sheet medium) thickness is 64 $g/m^2$, the difference between the time which is required for temperature increasing up to a temperature at which images can be output in the normal ready recovery control (sleep→waiting) shown in FIG. 15 (FIG. 14) and the time which is required for temperature increasing according to the embodiment shown in FIG. 7 (FIG. 6) is about 20%.

By employing such a configuration, in the recovery control for recovering the temperature of the fuser which fuses a toner image on a sheet medium from the sleep state where the above temperature is lower than in the ready (waiting) state where images can be instantly output to the ready state, the necessary time (waiting time) up to the image output (to actually output images) can be reduced in the image output only of black-and-white (B/W) images, except for the image output using only an arbitrary color different from the Bk toner.

In addition, when there is a B/W image output request and a color image output request during the recovery control for recovering the above-described fusing temperature from the sleep state where the above temperature is lower than in the ready (waiting) state to the ready state, the B/W image output is placed ahead of the color image output for which the waiting time increases in general. Accordingly, it is possible to increase the convenience of a user who demands the image output of B/W images which are required to be output with as shorter waiting time as possible.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

When the MFP 101 is connected to a network, the image data supply source (source for printing request of image output) may be a client PC (personal computer) on the network. In this case, when a printing request from the client PC is only for a B/W image and an image which is input by the scanner section 5 of the MFP 101 is a color image, the priority of the printout only of a B/W image is set to be behind that of the output of the color image which is input by the scanner section 5 due to the control of the CPU 139 (the above-described embodiments are cancelled). This is because regarding the printout from the client PC, it takes time for a user transmitting the printing request to collect the printouts.

What is claimed is:

1. An image forming apparatus comprising:

an image holding member which holds a toner image thereto:

an image transfer section which transfers the toner image onto a sheet medium:

a heating section which heats the sheet medium onto which the toner image is transferred;

a heat generator which increases temperature of the heating section;

a temperature detector which detects the temperature of the heating section; and a controller which controls the heating of the heating section by the heat generator until the temperature detector detects that a temperature at which fusing is possible for an image using a plurality of kind of toner is reached, and provides notification that fusing is possible for an image only using one kind of toner on the basis of the temperature of the heating section detected by the temperature detector while the temperature of the heating section increases;

wherein when an image data requested for printing is the image using two or more kinds of toner and the image using the one kind of toner for the Black/White image, the controller controls to start image output corresponding to the Black/White image data, if the temperature detector detects that the temperature of the heating section is a temperature at which the one kind of toner for the Black/White image can be fused.

2. The apparatus of claim 1, wherein when a number of printing job of the Black/White image is equal to or less than a predetermined number, the controller controls to start image output corresponding to the Black/White image data, if the temperature detector detects that the temperature of the heating section is a temperature at which the one kind of toner for the Black/White image can be fused.

3. The apparatus of claim 1, wherein when the image data requested for printing is a color image using two or more kinds of toner and a Black/White image and an external device supplies the Black/White image data, the controller continues the heating of the heating section by the heat generator until the temperature detector detects that a temperature at which fusing is possible for all the images is reached.

4. The apparatus of claim 3, wherein the color image is input by a scanner section.

5. The apparatus of claim 1, further comprising:

a display device which displays that fusing is possible for an image only using a single color toner on the basis of the temperature of the heating section detected by the temperature detector while the temperature of the heating section increases.

6. The apparatus of claim 5, wherein the display device which displays that fusing is possible for a color image when the temperature of the heating section detected by the temperature detector detects that a temperature at which fusing is possible for an image using a plurality of kind of toner is reached.

7. The apparatus of claim 1, wherein the heater section includes a heating roller which contains the heat generator inside.

8. The apparatus of claim 7, further comprising:

a pressure section which forms a nip with the heating section and gives a predetermined pressure to the sheet medium.

9. The apparatus of claim 8, further comprising:

an opposed pressure section which is positioned to be opposed to the pressure section and includes a delivery member delivering the heat of the heat roller to the pressure section.

10. An image forming method comprising:

forming a toner image on an image holding member;

transferring the toner image onto a sheet medium;

heating the sheet medium;

detecting temperature of the heating;

controlling the heating of the sheet medium until a fusing temperature is reached when using a plurality of kinds of toner, and providing notification that fusing is possible for an image only using one kind of toner on the basis of a heating temperature;

wherein when an image data requested for printing is an image using two or more kinds of toner and an image using the one kind of toner for the Black/White image, controlling a start image output corresponding to the Black/White image data, if the detected temperature is a temperature at which the one kind of toner for the Black/White image can be fused.

11. The method of claim 10, wherein when a number of printing job of the Black/White image is equal to or less than a predetermined number, controlling the start image output corresponding to the Black/White image data, if the detected temperature is a temperature at which the one kind of toner for the Black/White image can be fused.

12. The method of claim 10, wherein when the image data requested for printing is a color image using two or more kinds of toner and a Black/White image and an external device supplies the Black/White image data, controlling the heating until the detected temperature at which fusing is possible for all the images is reached.

13. The method of claim 12, inputting the color image by a scanner section.

14. The method of claim 10, further comprising:

displaying that fusing is possible for an image only using a single color toner on the basis of the detected temperature while the temperature of the heating section increases.

15. The method of claim 14, displaying that fusing is possible for a color image when detecting that a temperature at which fusing is possible for an image using a plurality of kind of toner is reached.

16. The method of claim 10, wherein heating is conducted using a heating roller which contains the heat generator inside.

17. The method of claim 16, further comprising:

providing a predetermined pressure to the sheet medium.

18. The method of claim 17, further comprising:

delivering heat of the heat roller to a pressure section.

* * * * *